US009371987B2

(12) United States Patent
Petänen et al.

(10) Patent No.: US 9,371,987 B2
(45) Date of Patent: Jun. 21, 2016

(54) STRUCTURE OF A SUPER HEATER

(75) Inventors: Pertti Petänen, Tampere (FI); Kari Mäkelä, Kangasala (FI); Kari Kuukkanen, Tampere (FI); Ari Kokko, Charlotte, NC (US)

(73) Assignee: Valmet Technologies Oy, Espoo (FI)

( * ) Notice: Subject to any disclaimer, the term of this patent is extended or adjusted under 35 U.S.C. 154(b) by 2167 days.

(21) Appl. No.: 11/794,478

(22) PCT Filed: Dec. 27, 2005

(86) PCT No.: PCT/FI2005/050489

§ 371 (c)(1),
(2), (4) Date: Sep. 22, 2009

(87) PCT Pub. No.: WO2006/070075

PCT Pub. Date: Jul. 6, 2006

(65) Prior Publication Data

US 2010/0000474 A1 Jan. 7, 2010

(30) Foreign Application Priority Data

Dec. 29, 2004 (FI) ..... 20045506

(51) Int. Cl.
*F22G 3/00* (2006.01)
*F22B 31/00* (2006.01)
*F22B 37/10* (2006.01)

(52) U.S. Cl.
CPC ..... *F22B 31/0084* (2013.01); *F22B 37/107* (2013.01); *F22G 3/008* (2013.01)

(58) Field of Classification Search
CPC ..... F01K 17/02; F23C 10/28; Y10S 122/13; F28F 1/00; F22B 31/0023
USPC ..... 122/367.1, 476; 165/104.16
See application file for complete search history.

(56) References Cited

U.S. PATENT DOCUMENTS 2,983,259 A * 5/1961 Wittke ..... F22B 31/0023 122/4 D
3,203,404 A * 8/1965 Miller ..... 122/236

(Continued)

FOREIGN PATENT DOCUMENTS

DE 101 31 524 A1 1/2003
FI 3125/67 A 5/1969

(Continued)

OTHER PUBLICATIONS

Finnish Office Action and English Translation—Feb. 18, 2008.

(Continued)

*Primary Examiner* — Alissa Tompkins
*Assistant Examiner* — John Bargero
(74) *Attorney, Agent, or Firm* — Venable LLP; Eric J. Franklin

(57) ABSTRACT

A method for reducing corrosion of a superheater of a steam boiler. The superheater includes a superheater piping. The superheating piping includes a steam pipe where the steam to be superheated is directed. The steam pipe is separated by a protective shell having a surface settling in the flue gas space has a temperature that rises above an upper critical temperature, above which temperature in the flue gas space the compounds from the fuel are substantially in a gaseous form. A superheater of a steam boiler and a circulating fluidized bed boiler.

12 Claims, 4 Drawing Sheets

(56) References Cited

U.S. PATENT DOCUMENTS

| | | | | | |
|---|---|---|---|---|---|
| 3,351,361 | A | * | 11/1967 | Martin | 285/47 |
| 4,304,267 | A | | 12/1981 | Campbell, Jr. | |
| 4,714,049 | A | * | 12/1987 | McCoy et al. | 122/4 D |
| 4,852,645 | A | * | 8/1989 | Coulon et al. | 165/180 |
| 5,881,802 | A | | 3/1999 | Green | |
| 6,136,117 | A | | 10/2000 | Shibata et al. | |
| 6,532,905 | B2 | * | 3/2003 | Belin et al. | 122/4 D |
| 6,672,259 | B2 | | 1/2004 | Blomberg | |
| 2003/0089318 | A1 | * | 5/2003 | Watanabe | 122/406.1 |

FOREIGN PATENT DOCUMENTS

| | | | | | |
|---|---|---|---|---|---|
| FR | 2700603 | A1 | * | 7/1994 | F22B 37/10 |
| GB | 2 263 330 | A | | 7/1993 | |
| JP | 07-239104 | A | | 9/1995 | |

OTHER PUBLICATIONS

PCT/ISA/210—International Search Report—Apr. 8, 2006.
PCT/IPEA /409—International Prepliminary Report on Patentability—Apr. 24, 2007.
Finnish Office Action, Along With Translation From Finnish Original Office Action—Jul. 20, 2005.

* cited by examiner

STRUCTURE OF A SUPER HEATER

CROSS-REFERENCE TO RELATED APPLICATIONS

This application claims priority to Finnish patent application 20045506 filed 29 Dec. 2004 and is the national phase under 35 U.S.C. §371 of PCT/FI2005/050489 filed 27 Dec. 2005.

FIELD OF THE INVENTION

The invention relates to a method for reducing corrosion of a superheater of a steam boiler. The invention also relates to a superheater of a steam boiler, as well as a circulating fluidized bed boiler.

BACKGROUND OF THE INVENTION

The invention relates to the structure of a superheater of a steam boiler. Superheaters of steam boilers are typically placed in a flue gas flow and in circulating fluidized bed boilers (CFB-boiler) superheaters or a part of the superheaters can be placed below the cyclone, in a so-called loopseal (sand seal). The Increase of the superheating temperature and the heat-to-power ratio of the plant are for their part limited by superheater corrosion. The corrosion mechanism varies depending on combustion, structure and most of all the chemical composition of ash and combustion gases.

In boilers using waste and biomass a high content of chlorine (Cl) combined with a high alkali content—which is primarily formed of sodium (Na) and potassium (K)—may lead to a heavy fouling and corrosion of the heat exchange surfaces. Waste and biomass type fuels are especially problematic, because typically their sulphur content (S) is low in relation to their chlorine content, in which case the alkali form alkali chlorides and not alkali sulphates. The compounds being created, in turn, typically have a relatively low melting temperature. The smelt material being created adheres onto the surface of the superheater and creates corrosion. Several other compounds created in the combustion process have corresponding properties as well.

Corrosion is aimed to be controlled by selecting materials that endure corrosion better either over the entire thickness of the material or for the part of the surface layer of the pipe. In addition, corrosion is aimed to be decreased by designing the surface temperature of the superheater below the melting temperature. A low temperature of the superheated steam is not advantageous from the point of view of the operational economy of the plant (lower electricity production).

The surface temperature of the material of a typical superheater is, by means of the present technique, a few tens of degrees higher than the temperature of the contents, depending on the conditions. In practice, the surface temperature and corrosion rate of the material can be substantially affected only by changing the temperature of the contents, i.e. by limiting the superheating temperature.

A superheater material that must simultaneously endure corrosion, high pressure and high temperature, is typically expensive.

SUMMARY OF THE INVENTION

Now a superheater solution has been invented, which enables a decrease in the corrosion of the superheater.

To attain this purpose, the present invention includes a method a superheater of a steam boiler and a circulating fluidized bed boiler according to the invention.

The basic idea of the Invention is to arrange the temperature of the surface of the superheater so high that the formation of a critical amount of smelt is prevented on the surface of the superheater. In known solutions the temperature of the surface of the superheater is aimed to be kept below that temperature where the compounds turn into smelt to such a degree that corrosion begins to accelerate. FIG. 1 shows in principle the amount of smelt material comprised by a flue gas in relation to material in other states as a function of temperature. As can be seen from the figure, there is some first limiting temperature $T_0$, after which the smelt begins to form. In higher temperatures the proportion of the smelt material begins to increase. In addition, there is another limiting temperature $T_{k1}$, after which the amount of smelt material is critical from the point of view of corrosion. In addition, there is a third limiting temperature $T_{k2}$ (upper critical temperature), above which the amount of smelt on the surface of the superheater is below the amount that is critical from the point of view of corrosion. Above the upper critical temperature $T_{k2}$ the compounds are substantially in a gaseous form. The temperature area between the second limiting temperature $T_{k1}$ and the upper limiting temperature $T_{k2}$ is later called the critical temperature area $T_{k1}$-$T_{k2}$. The limiting temperatures and the form of the diagram depend substantially on the compound.

Now such a solution is disclosed for reducing the corrosion and fouling of the superheater, wherein the surface temperature of the superheater is higher than the upper critical temperature $T_{k2}$. As can be seen from FIG. 2, the temperature area of the outer surface of the superheater is above the upper critical temperature $T_{k2}$. FIG. 2 also shows in principle that temperature area of the steam to be superheated enabled by the invention. The present solution enables the superheating of steam to a higher temperature with the above-described problematic fuels as well. In known solutions most often the pressure and temperature durability of the material prevents raising the temperature above the upper critical temperature $T_{k2}$.

According to a basic idea of the invention the surface of the steam pipe in the superheater is separated from the corroding compounds by a protective shell, the surface of which shell has temperature designed above the upper critical temperature $T_{k2}$, in which temperature the compounds from the fuel are in a gaseous form. According to an advantageous embodiment of the invention the protective shell protects the steam pipe from corroding gases. Thus, the agents causing corrosion do not come into contact with the steam pipe.

In an embodiment of the invention a sufficient insulator is arranged between the protective shell and the steam pipe in order to control the conduction of heat. Thus, the temperature of the steam pipe is substantially lower than the temperature of the protective shell.

In another advantageous embodiment the heat conductivity of the protective shell is selected in such a manner that a separate insulator on the surface of the steam pipe of the superheater is not needed.

In an advantageous embodiment no pressure formed in the steam is directed at the protective shell. Thus, the protective shell primarily needs to endure the high temperature of the environment.

By arranging the temperature of the surface of the superheater higher than the upper critical temperature $T_{k2}$, the collection of deposits on the surface of the superheater is substantially prevented. Thus, the corrosion of the superheater as well as fouling decreases. This results in a decrease in that the superheater requires less cleaning and maintenance.

The different embodiments of the invention offer various advantages over solutions of prior art. There can be one or more of the following advantages in an application depending on its implementation.

- the superheating temperature of a boiler can be raised and the electricity production of a power plant can be increased, which results in a better economic efficiency
- a wider selection of even demanding fuels can be used
- the usability of the boiler increases
- the superheater is inexpensive to maintain, because the targets requiring most of the maintenance is the protective shell, which is a non-pressurized structure and not a reactor vessel
- the material of the protective shell can be selected primarily on the basis of temperature endurance (i.e. pressure endurance is not required)
- as the reactor vessel materials of the superheater it is possible to use more inexpensive materials, which do not need to endure the corrosion caused by flue gases

DESCRIPTION OF THE DRAWINGS

In the following, the invention will be described in more detail with reference to the appended principle drawings, in which.

DETAILED DESCRIPTION OF THE INVENTION

Figure 3:
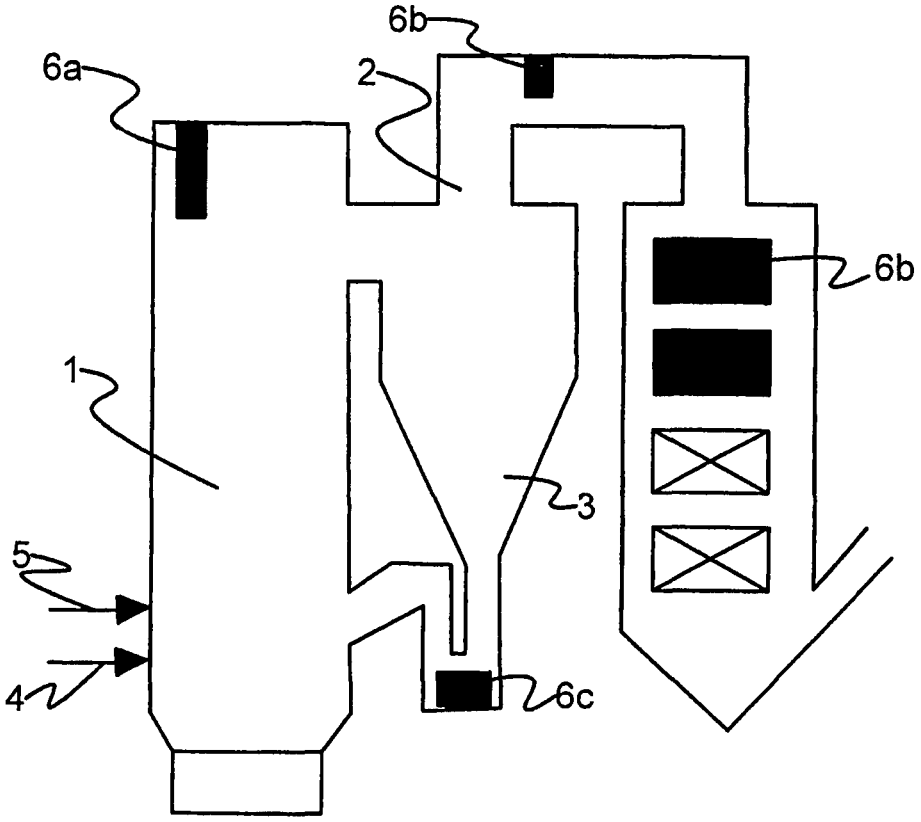
FIG. 3 shows a circulating fluidized bed boiler

FIG. 3 shows in principle the structure of a circulating fluidized bed boiler. The boiler comprises a furnace 1, flue gas channels 2 and a cyclone 3, where the flue gases formed in the combustion can flow. In addition, FIG. 3 shows fuel supply 4 and combustion air supply 5, which are connected to the furnace 1, which may be on several layers. Flue gas cleaning systems are not shown in the figure.

In addition, the boiler comprises one of more superheaters 6*a*, 6*b*, 6*c*. The type of the superheater may be, for example, a radiant superheater 6*a* in the furnace, a superheater 6*b* in the flue gas channel, or a loopseal superheater 6*c* placed after the cyclone. In the following, the invention is described using the loopseal superheater 6*c* as an example, which is referred to as the superheater. It is, however, possible to apply the same principle for other superheaters 6*a*, 6*b*, 6*c* as well.

Figure 4:
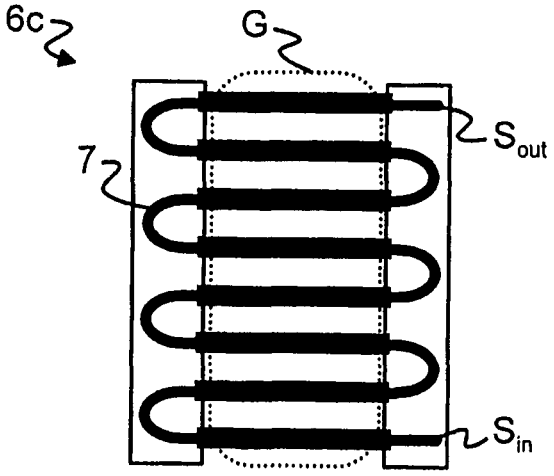
FIG. 4 shows a superheater according to the invention.

FIG. 4 shows the principle structure of the superheater 6*c* according to the invention. The superheater 6*c* comprises a superheating piping 7, whose straight parts are inside a fluidized bed, in which case they are in a space G exposed to flue gases and/or bed material. The curved parts of the superheating piping 7—as well as the steam connections $S_{in}$, $S_{out}$, of the superheater—are arranged in a space separated from the fluidized bed material. The figure shows a way to implement the superheater 6*c*, but it is possible to be implemented in several different manners, however, by maintaining the basic idea of this invention.

Figure 5:
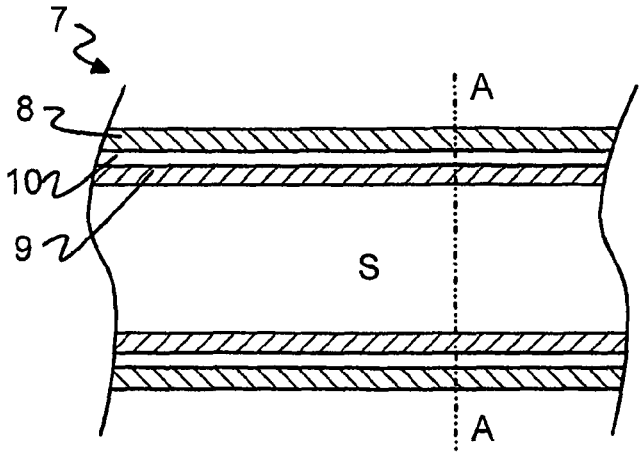
FIG. 5 shows an embodiment according to the invention.
Figure 6:
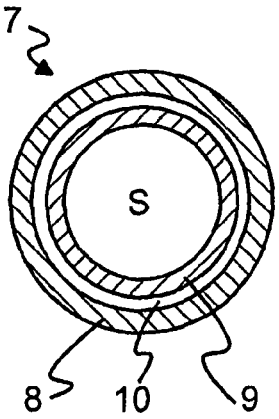
FIG. 6 shows a cross-section of the embodiment according to FIG. 5 at point A-A.

FIG. 5 shows the longitudinal cross-section of a corrosion-shielded superheating piping 7 according to an embodiment of the invention. FIG. 6, in turn, shows a cross-section of the superheating piping 7 at point A-A of FIG. 5. As can be seen in the figures, the superheating piping 7 comprises a protective shell 8 and the steam pipe 9 inside it. In the example according to FIGS. 5 and 6 there is an air slot 10 between the protective shell 8 and the steam pipe 9, which conducts the heat in the manner desired in the example from the protective shell to the steam pipe.

The temperature of the protective shell 8 is aimed to be kept above the critical temperature point $T_{k2}$. Above the upper critical temperature $T_{k2}$ the corrosive compounds in the flue gases are substantially in a gaseous form. For example, it has been detected in waste combustion that the upper critical temperature $T_{k2}$ is of the order of 600 to 650° C. The upper critical temperature $T_{k2}$, however, depends substantially on the combustion, the structure, and most of all the chemical composition of ash and combustion gases.

Above the upper critical temperature $T_{k2}$ the corrosive compounds in the flue gases are substantially in a gaseous form. When the surface temperature of the superheater 6*c* is higher than the upper critical temperature $T_{k2}$, the compounds in a gaseous form do not deposit on the surfaces of the superheater 6*c*. If the temperature of the flue gases on the surface drops below the upper critical temperature $T_{k2}$, the amount of smelt material is substantially increased. This smelt material is easily deposited on the surface of the superheater creating corrosion and fouling. Because of this, it is advantageous to keep the temperature of the protective shell 8 high enough in comparison to the critical temperature $T_{k2}$.

Figure 7:
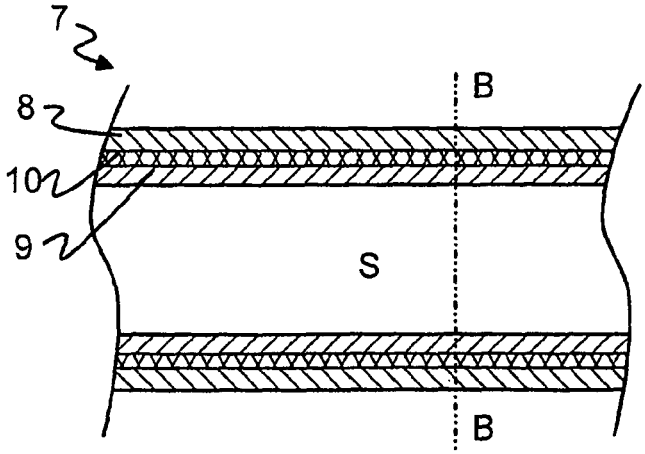
FIG. 7 shows another embodiment according to the Invention.
Figure 8:
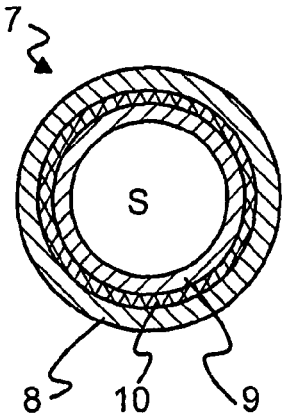
FIG. 8 shows a cross-section of the embodiment according to FIG. 7 at point B-B.

The steam S to be superheated travelling in the steam pipe 9 cools the steam pipe, which, in turn, cools the protective shell 8. The temperature of the steam S to be superheated may vary application-specifically. Often the temperature of the steam S is 450 to 480° C. When the temperature of the steam S is substantially below the upper critical temperature $T_{k2}$, the excessive cooling of the protective shell 8 must be prevented. In FIGS. 5 and 6 the heat exchange between the protective shell 8 and the steam pipe 9 is controlled by an air slot 10. By using some other insulation besides the air slot 10 or in addition to it, the heat exchange properties can be adapted to better suit the application. In FIGS. 7 and 8 the heat exchange is controlled by an insulation 10, which is located between the protective shell 8 and the steam pipe 9.

Figure 9:
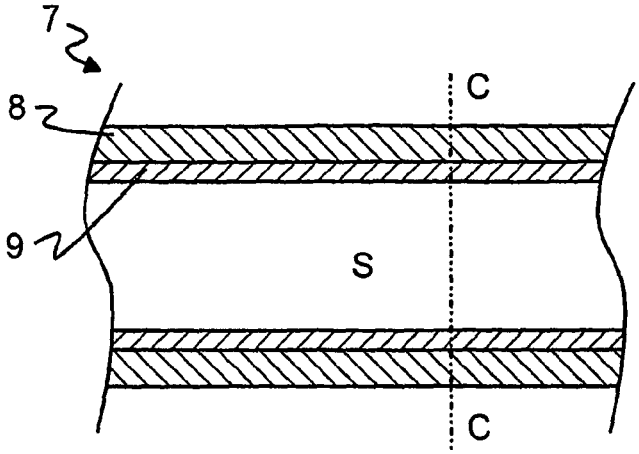
FIG. 9 shows a third embodiment according to the invention.
Figure 10:
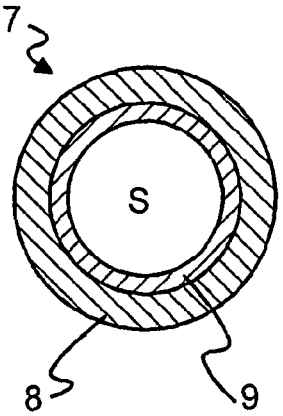
FIG. 10 shows a cross-section of the embodiment according to FIG. 9 at point C-C, For the sake of clarity, the figures only show the details necessary for understanding the invention. The structures and details that are not necessary for understanding the invention, but are obvious for anyone skilled in the art, have been omitted from the figures in order to emphasize the characteristics of the invention.

FIGS. 9 and 10, in turn, show an embodiment of the superheater 6*c* according to the invention, wherein the heat conductivity of the protective shell 8 is selected in such a manner that a separate insulation between the steam pipe 9 of the superheater and the protective shell 8 is not needed. In the solution in question the temperature of the protective shell 8 drops in a controlled manner from the temperature of the outer surface to the temperature of the inside, the difference of which temperatures is substantially significant. The heat conductivity can be affected, for example, with materials and/or structural solutions. The heat conductivity of the structure is selected in such a manner that a separate insulation between the steam pipe 9 of the superheater 6*c* and the protective shell is not needed.

In the material selection of different structures of the superheater 6*c* it must be taken into account that the protective shell 8 must mainly endure heat and flue gases, i.e. it does not need to endure pressure as in known solutions. The steam pipe 9 must, in turn, endure pressure, but not corrosive flue gases. The materials in question are substantially less expensive than the corrosion and pressure enduring materials used in known structures. The insulator 10 can be gas, such as, for example, air, liquid or solid material, such as, for example, a coating, a refractory or a separate structure.

Figure 1:
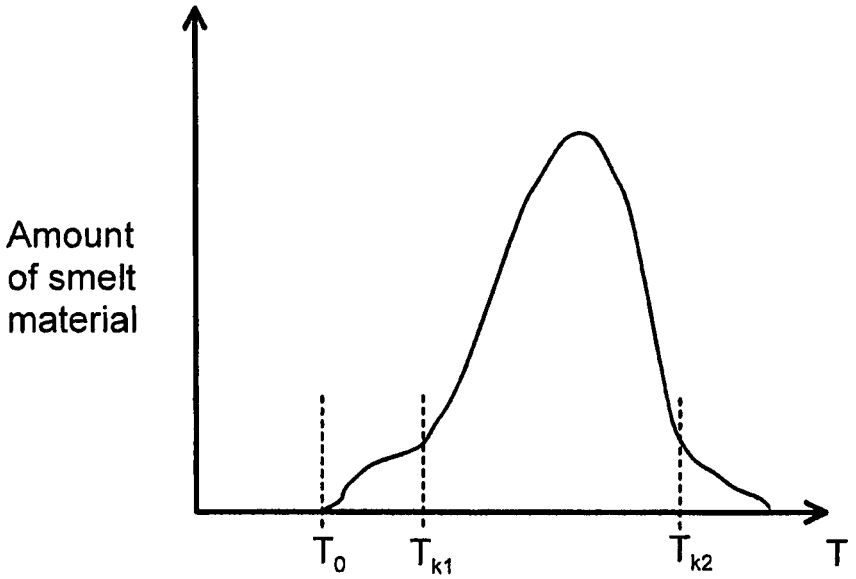
FIG. 1 shows the amount of smelt material comprised by a flue gas as the function of temperature
Figure 2:
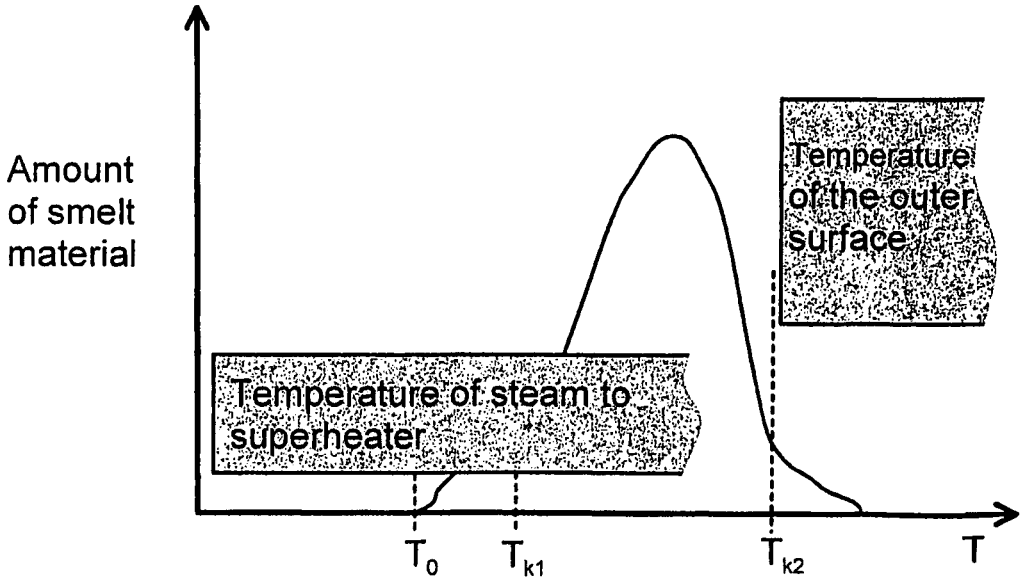
FIG. 2 shows the operation temperature areas of the outer surface of the superheater and the steam to be superheated

An embodiment enables superheating the steam S into such temperature that is between the limiting temperatures $T_{k1}$ and $T_{k2}$, i.e. on the critical temperature area $T_{k1}$-$T_{k2}$ (i.e. on areas $T_{k1}$-$T_{k2}$ of FIGS. 1 and 2) without the compounds significantly depositing on the surface of the superheater piping 7. No significant depositing takes place from the point of view of corrosion, because the steam pipe 9 on said critical temperature area $T_{k1}$-$T_{k2}$ is insulated from flue gases and/or fluidized material and the temperature of the protective shell 8 is above the upper critical temperature $T_{k2}$. This enables such superheating temperatures, which with known solutions would be uneconomical because of, inter alia, corrosion and fouling.

The steam pipe 9 of the superheater 6*c* and the protective shell 8, and in some embodiments also the insulator 10, may have different heat expansion properties. This seems to be due to the different temperatures of different parts and partly due to the different materials. In an embodiment the steam pipe 9 is arranged inside the protective shell 8 without it being rigidly fixed to it. In another embodiment the steam pipe 9 is, in turn, fixed rigidly to only one point of the protective shell 8, such as, for example, the other end of the protective shell. Thus, the steam pipe 9 and the protective shell 8 may expand independent of each other.

The above-presented structure of the superheater piping 7 is also very use friendly, because its maintenance procedures are easy to perform. Especially in the loopseal superheater 6*c* the protective shell 8 is worn in use in such a manner that is must be renewed from time to time. In the presented solution the change of the protective shell 8 is usually sufficient, which may be performed by conventional methods. For example, the old protective shell 8 can be cut and removed. A replacement protective sheet 8 can in an embodiment be formed of two pipe halves, which are connected together after they have been set around the steam pipe 9. Because pressure effect is not directed to the protective shell 8 in use, its welding does not have the same requirements as welding the pressure-enduring pipes of a conventional superheater 6.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the Invention may be freely varied within the scope of the inventive features presented in the claims hereinbelow.

The invention claimed is:

1. A method for reducing corrosion of a fluidized bed heat exchanger of a circulating fluidized bed boiler comprising a cyclone and a loopseal arranged below the cyclone, the method comprising:

providing the fluidized bed heat exchanger comprising a superheater piping, the superheater piping comprising a steam pipe and a protective shell configured to separate the steam pipe from corroding compounds, the superheating piping comprising straight portions, curved portions and steam connections;

arranging the fluidized bed heat exchanger inside a fluidized bed of the loopseal, such that the straight portions of the superheater piping are exposed to bed material and the curved portions and the steam connections of the superheating piping are arranged in the loopseal in a space separated from the fluidized bed material; and directing steam to be superheated to the superheating piping, such that a surface temperature of the protective shell is above a temperature of 600° C.

2. The method according to claim 1, wherein an insulator is arranged between the steam pipe and the protective shell for controlling heat conduction.

3. The method according to claim 1, wherein no pressure formed in the steam is directed at the protective shell.

4. A circulating fluidized bed boiler, comprising:

a cyclone;

a loopseal arranged below the cyclone;

a fluidized bed in the loopseal; and a superheater piping of a fluidized bed heat exchanger, the superheating piping comprising straight portions inside the fluidized bed of the loopseal exposed to bed material, the piping comprising a steam pipe and a protective shell that surrounds the steam pipe and separates the steam pipe from the fluidized bed material in such a manner that the surface temperature of the protective shell is arranged in use conditions above a temperature of 600° C., wherein the superheating piping further comprises curved portions and steam connections, such that the curved portions and the steam connections of the superheating piping are arranged in the loopseal in a space separated from the fluidized bed material.

5. The circulating fluidized bed boiler according to claim 4, further comprising:

an insulator arranged between the protective shell and the steam pipe.

6. The circulating fluidized bed boiler according to claim 4, wherein the protective shell of the fluidized bed heat exchanger is substantially non-pressurized.

7. The circulating fluidized bed boiler of claim 4, wherein the surface temperature of the protective shell is above a temperature of 600° C. results from at least one of a heat conductivity of the protective shell, the superheater piping comprising insulator, or an air slot being arranged in between the protective shell and the steam pipe.

8. The circulating fluidized bed boiler of claim 7, wherein the steam pipe is arranged inside the protective shell, and wherein an air slot is arranged in between the protective shell and the steam pipe.

9. The circulating fluidized bed boiler of claim 8, wherein the steam pipe is fixed to the protective shell such that the steam pipe and the protective shell may expand independently of each other.

10. The circulating fluidized bed boiler of claim 7, wherein the heat conductivity of the protective shell is selected such that the surface temperature of the protective shell is arranged in the use conditions above a temperature of 600° C. and a material of the protective shell endures heat and flue gases.

11. The circulating fluidized bed boiler of claim 7, wherein the superheater piping comprises an insulator comprising solid material.

12. The circulating fluidized bed boiler of claim 11, wherein the steam pipe is fixed to the protective shell such that the steam pipe and the protective shell may expand independently of each other.

* * * * *